US009642194B2

(12) United States Patent
Wilber et al.

(10) Patent No.: US 9,642,194 B2
(45) Date of Patent: May 2, 2017

(54) TUBULAR CHOKED WAVEGUIDE APPLICATOR

(71) Applicant: Industrial Microwave Systems, L.L.C., Harahan, LA (US)

(72) Inventors: William D. Wilber, Raleigh, NC (US); Donald B. Shuping, Pittsboro, NC (US)

(73) Assignee: Industrial Microwave Systems, L.L.C., Harahan, LA (US)

( * ) Notice: Subject to any disclaimer, the term of this patent is extended or adjusted under 35 U.S.C. 154(b) by 338 days.

(21) Appl. No.: 14/453,820

(22) Filed: Aug. 7, 2014

(65) Prior Publication Data

US 2016/0044750 A1 Feb. 11, 2016

(51) Int. Cl.
*H05B 6/70* (2006.01)
*H05B 6/76* (2006.01)

(52) U.S. Cl.
CPC ..... *H05B 6/707* (2013.01); *H05B 6/701* (2013.01); *H05B 6/76* (2013.01); *H05B 2206/046* (2013.01)

(58) Field of Classification Search
CPC ..... H05B 6/707; H05B 6/701; H05B 6/76; H05B 2206/046
USPC ..... 219/688, 690, 693, 696, 699, 728, 744, 219/756
See application file for complete search history.

(56) References Cited

U.S. PATENT DOCUMENTS 3,155,923 A 11/1964 Persson
3,442,663 A 5/1969 Turbak
3,457,385 A 7/1969 Cumming
3,461,261 A 8/1969 Lewis et al.
3,590,202 A 6/1971 Day et al.
3,665,141 A * 5/1972 Schiffmann ..... H05B 6/782 219/699
3,858,022 A 12/1974 Smith
4,006,339 A * 2/1977 Maurer ..... H05B 6/72 219/693
4,330,946 A 5/1982 Courneya
(Continued)

FOREIGN PATENT DOCUMENTS

EP 0113900 B1 11/1988
EP 2243377 A1 10/2010
(Continued)

OTHER PUBLICATIONS

Extended European Search Report, EP Appl. No. 15179898.0, mailed Oct. 21, 2015, European Patent Office.

*Primary Examiner* — Thien S Tran
(74) *Attorney, Agent, or Firm* — James T. Cronvich

(57) ABSTRACT

A microwave heating apparatus with a tubular waveguide applicator and reactive and resistive chokes to decrease leakage. Microwave-transparent centering elements maintain articles to be treated centered in the applicator. Articles, such as individual cylindrical articles or continuous cylindrical strands, advance through the applicator in a direction in or opposite to the direction of propagation of microwaves. The resistive chokes have conductive vanes coated with a dielectric material that absorbs microwave energy that leaks through the reactive chokes to allow for large openings for large-diameter articles. The waveguide applicator is operated in the $TE_{01}$ mode to concentrate microwave heating energy along the outer circumferences of the articles.

10 Claims, 3 Drawing Sheets

(56) References Cited

U.S. PATENT DOCUMENTS

| | | | |
|---|---|---|---|
| 4,488,027 | A | 12/1984 | Dudley et al. |
| 4,497,759 | A | 2/1985 | Nakagawa et al. |
| 5,107,602 | A | 4/1992 | Loof |
| 5,314,647 | A | 5/1994 | Rieth |
| 5,834,744 | A | 11/1998 | Risman |
| 5,869,817 | A | 2/1999 | Zietlow et al. |
| 5,955,126 | A | 9/1999 | Jon et al. |
| 6,322,832 | B1 | 11/2001 | Schiffmann |
| 6,326,039 | B1 | 12/2001 | Schiffmann et al. |
| 6,833,537 | B2 | 12/2004 | Risman et al. |
| 7,390,245 | B2 | 6/2008 | Brettschneider |
| 8,268,129 | B2 | 9/2012 | Hammer et al. |
| 8,529,723 | B2 | 9/2013 | Fu et al. |
| 8,785,827 | B2 | 7/2014 | Corcoran, Jr. |
| 2010/0311296 | A1 | 12/2010 | Boehmer et al. |
| 2012/0304482 | A1 | 12/2012 | Willers et al. |
| 2013/0098904 | A1 | 4/2013 | Harada et al. |

FOREIGN PATENT DOCUMENTS

| | | | |
|---|---|---|---|
| GB | 2262421 | A | 6/1993 |
| WO | 2012060348 | A1 | 5/2012 |
| WO | 2014190974 | A1 | 12/2014 |

* cited by examiner

TUBULAR CHOKED WAVEGUIDE APPLICATOR

BACKGROUND

The invention relates generally to microwave heating apparatus and more particularly to waveguide applicators for heating or drying products with microwaves.

Microwaves are often used in industrial processes to heat or dry products. For example, U.S. Pat. No. 4,497,759 describes a waveguide system for dielectrically heating a crystalline polymer drawn into a rod fed continuously through a circular waveguide applicator along its centerline. The $TM_{01}$ mode is used to concentrate the heating along the centerline. The narrow waveguide applicator has an inner diameter of 95.6 mm, which limits its use to small-diameter products, such as drawn polymer rods. For continuous heating and drying processes in which individual products or a product strand is fed continuously through a waveguide applicator, openings are provided at opposite ends of the applicator for product entry and exit. But microwave radiation can also leak through the openings, especially if the openings are large to accommodate large-diameter products.

SUMMARY

One version of a microwave heating apparatus embodying features of the invention comprises a tubular waveguide applicator forming a heating chamber between a first end and an opposite second end. The applicator has a circular cross section and an axis along its centerline. A waveguide feed connected between a microwave source and the tubular waveguide applicator at the first end propagates microwaves through the tubular waveguide applicator from the first end to the second end with a dominant $TE_{01}$ field pattern in the heating chamber. A first resistive choke is connected in series with the tubular waveguide applicator at the first end. A second resistive choke is connected in series the tubular waveguide applicator at the second end. Each of the resistive chokes includes a plurality of conductive vanes covered with a microwave-absorbent material and spaced apart along the axis in a chevron pattern. The vanes have central apertures aligned with openings in the opposite ends of the resistive chokes and with the heating chamber to guide articles to be treated in the heating chamber through the resistive chokes.

Another version of a microwave heating apparatus comprises a tubular waveguide applicator that has a cylindrical outer wall terminating in a first end and an opposite second end to form a heating chamber with a circular cross section between the first and second ends with an axis along the heating chamber's centerline. A microwave source supplies microwave energy into the tubular waveguide applicator. A first reactive choke is disposed in series with the tubular waveguide applicator at the first end of the tubular waveguide applicator. A second reactive choke is disposed in series with the tubular waveguide applicator at the second end of the tubular waveguide applicator. A first resistive choke is connected in series with the tubular waveguide applicator and the first reactive choke. A second resistive choke is connected in series with the tubular waveguide applicator and the second reactive choke.

BRIEF DESCRIPTION OF THE DRAWINGS

These features of the invention are described in more detail in the following description, appended claims, and accompanying drawings, in which:

DETAILED DESCRIPTION

Figure 1:
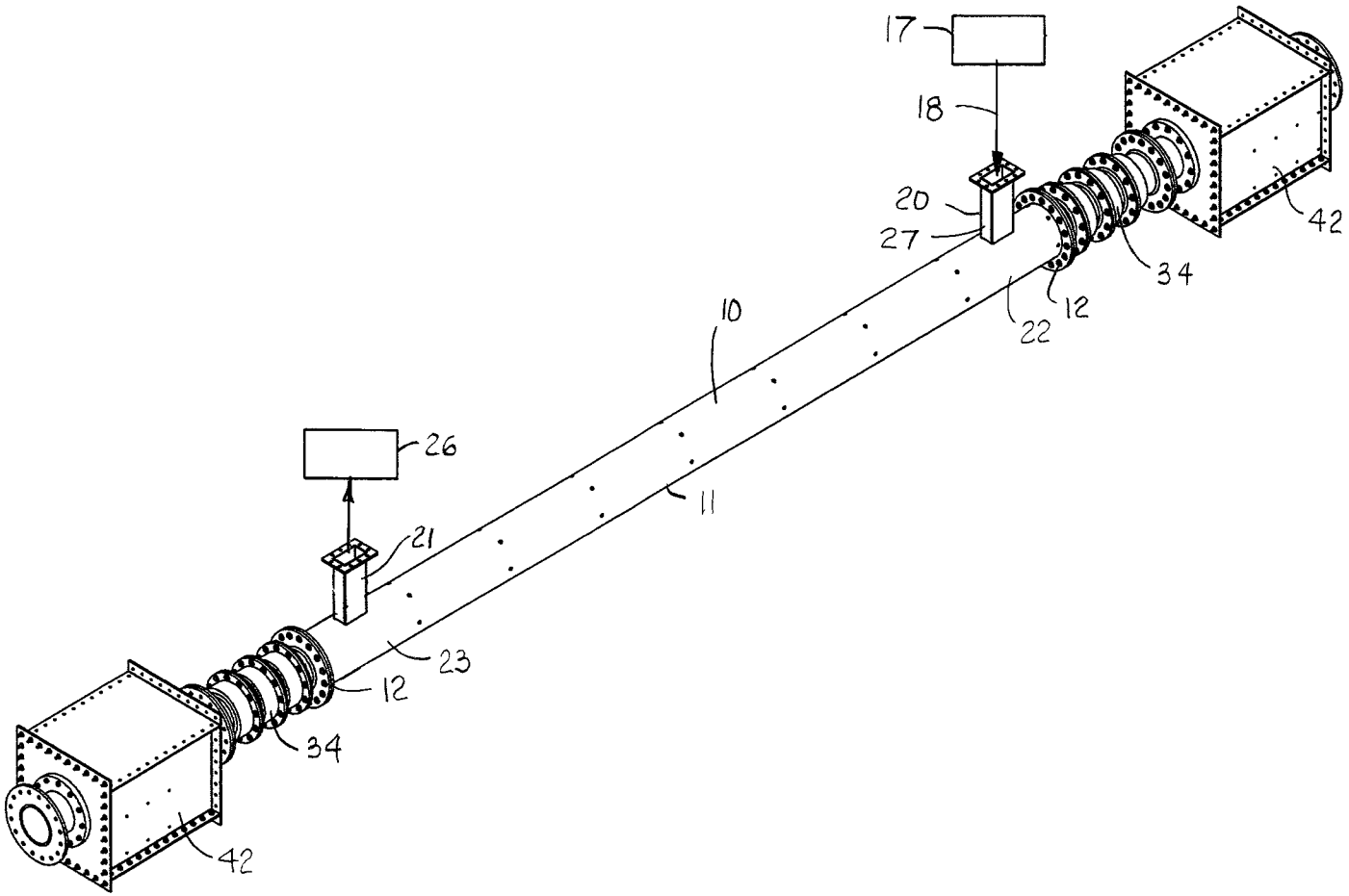
FIG. 1 is an isometric view of a tubular waveguide applicator embodying features of the invention.
Figure 2:
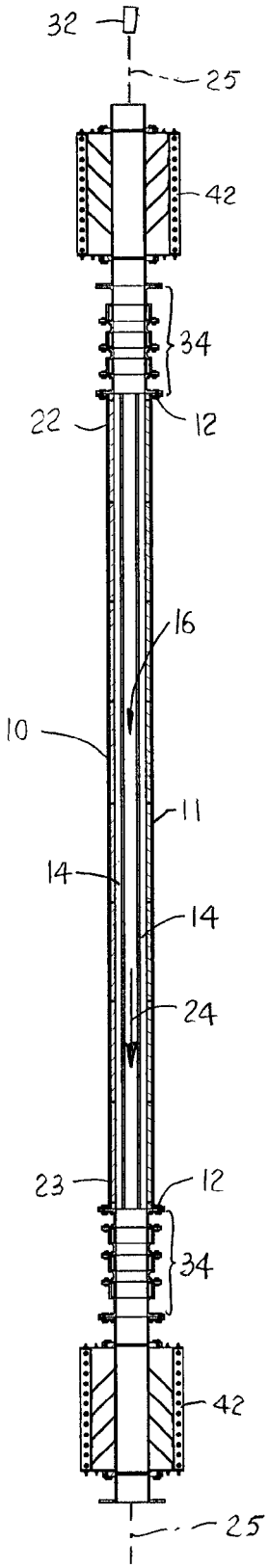
FIG. 2 is a cross section of the waveguide applicator of FIG. 1.

A microwave heating apparatus embodying features of the invention, including a tubular waveguide applicator, is shown in FIGS. 1 and 2. The applicator 10 shown in this example is constructed of a single circular waveguide section having a cylindrical outer wall 11 forming a heating chamber. But the applicator could be constructed of a series of individual circular waveguide sections connected end to end. The applicator 10 has circular flanges 12 at each end. Plastic or teflon ribs 14 extend radially inward from the inside surface of the metal waveguide walls. The ribs 14, which extend along the length of the applicator 10, are spaced apart circumferentially around the inner circumference of the applicator. The plastic or teflon ribs 14 are transparent to microwaves. The ribs extend radially inward a distance sufficient to bound a central bore 16 through the heating chamber through which articles, such as individual cylindrical items or a continuous cylindrical strand, can pass. The ribs 14 center and guide the articles through the central bore 16.

A microwave source 17 injects microwaves 18, for example, at 915 MHz or 2540 MHz, into the waveguide applicator 10 through a rectangular waveguide feed 20 at an entrance end 22 of the applicator. The microwaves propagate along the waveguide applicator 10 from the entrance end 22 to an exit end 23. The microwaves travel through the interior of the applicator 10 in a direction of propagation 24 parallel to the axis 25 of the applicator. Microwave energy unabsorbed by the articles to be treated in the heating chamber exits the exit end 23 through a rectangular waveguide segment 21 to a dummy load 26, which prevents reflections back into the applicator. But it would also be possible to operate without a dummy load and allow the microwave energy to reflect back through the applicator 10 toward the entrance end 22 and, in that way, double the effective length of the applicator. The shorter sides 27 of the rectangular waveguide feed 20, which define the feed's E plane, are perpendicular to the axis 25 of the applicator 10 to produce an electric field pattern in which the $TE_{01}$ mode is dominant.

Figure 5:
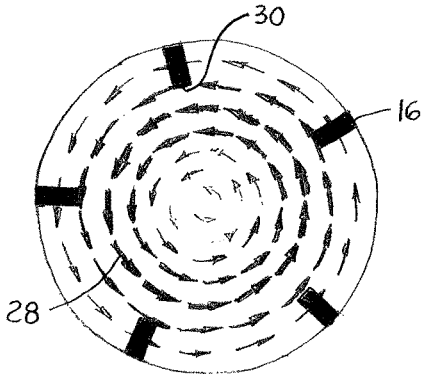
FIG. 5 is a cross section of the tubular applicator of FIG. 1 showing the electric-field pattern.

As shown in FIG. 5, the $TE_{01}$ mode produces an electric field with circular symmetry in the applicator 10 and with its maximum electric-field intensity midway between the centerline and the cylindrical outer wall 11 of the applicator. This increased field intensity between the center and the wall is indicated by the bolder and denser arrows 28 concentrically circling the centerline in the electric-field pattern shown in FIG. 5. The magnitude of the electric field at any position along the applicator varies sinusoidally with the passing traveling microwave with reversals of direction every half cycle. Because the field intensity is greatest near the inner ends 30 of the guide ribs 14, the applicator 10 is especially useful in applications that require the outer circumference of the cylindrical article to be heated.

As shown in FIG. 2, cylindrical articles 32 enter the vertically oriented applicator 10 at the upper end and fall through the applicator aided by gravity. The articles 32 advance through the applicator 10 in or opposite to the direction of propagation 24 of the microwaves. The articles could be advanced through the applicator by an injected air stream instead of or in addition to gravity. As the articles fall, the microwaves heat the outer portions. For large-diameter articles the central bore has to be relatively large with respect to the cross-sectional dimensions of the waveguide applicator 10. For that reason leakage of microwave energy through the large openings at the ends 22, 23 of the applicator is reduced by two chokes 34, 42 at each end.

Figure 3:
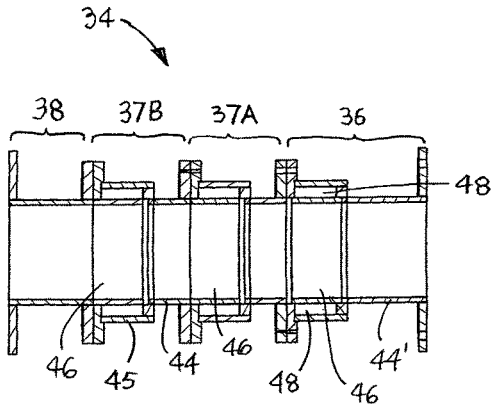
FIG. 3 is an enlarged cross section of a reactive choke in the applicator of FIG. 1.

The chokes 34 closer to the applicator are reactive chokes that reflect microwave energy back into the applicator. The reactive chokes 34 are positioned at the ends 22, 23 of the applicator 10. The reactive chokes 34 shown in FIG. 3 in more detail are constructed of four metal circular waveguide segments 36, 37A, 37B, 38. Each segment has a flange 40 at each end to attach to the flange of another segment, of the applicator 10, or of a choke box 42 (FIG. 1) with screws, for example. The left-most segment 38 in FIG. 3 is a flanged cylindrical metallic tube having a circular bore. The identical interior metallic waveguide segments 37A, 37B are flanged at each end and have a stepped bore formed by a small-diameter section 44 and a large-diameter section 45. The small-diameter section 44 has the same inner diameter as the left-most segment 38. The right-most segment 36 is the same as the interior segments 37A, 37B, except that the small-diameter section 44' is elongated. A plastic or teflon microwave-transparent ring 46 having the same inner diameter as the small-diameter sections 44, 44' is retained in the large-diameter end of each interior waveguide segment 37A, 37B and the right-most segment 36. When the waveguide segments are fastened to each other, the rings 46 are clamped in place and form a continuous smooth bore with the small-diameter sections 44, 44' and the bore of the left-most segment 38. The smooth bore allows cylindrical articles to pass through without snagging. Air gaps 48 are formed between the walls of the large-diameter sections 45 and the rings 46. The air gaps 48 are spaced apart axially on quarter-wavelength centers (about 2.9 cm at 2540 MHz). The quarter-wavelength spacing of the steps in the waveguide's diameter provides choking that reduces the leakage of microwave energy.

Figure 4:
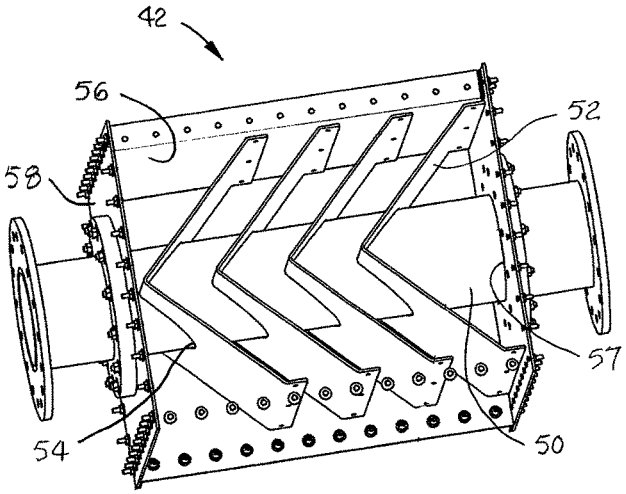
FIG. 4 is an enlarged cross section of a resistive choke in the application of FIG. 1.

Because of the large opening required to accommodate large-diameter articles entering and exiting the reactive chokes 34, the reactive chokes may not reduce leakage enough. So resistive, absorbing choke boxes 42 (FIG. 1) are connected in series with the reactive chokes 34. The resistive chokes 42 are shown in more detail in FIG. 4. The choke box 42 is shown as a rectangular box in FIG. 4, but it could be another shape, such as circular or elliptic cylindrical. The dimensions of the choke box 42 are greater than the diameter of the bore formed in a plastic or teflon tube 50 extending centrally through the choke box. V-shaped, conductive metallic vanes 52 arranged in a chevron pattern have central apertures 54 to receive the microwave-transparent tube 50 that guides the articles centrally through the choke box 42. The vanes 52 are attached at their opposite ends to one pair of side walls 56 of the choke box. Openings 57 in end walls 58 are aligned with central apertures 54 in the vanes to admit the tube 50 and guide articles centrally through the choke and into the applicator. The metallic vanes are coated with a dielectric material, such as Eccosorb, that absorbs microwave energy. Like the steps in the reactive chokes 34, the vanes are spaced apart in the axial direction by a quarter of the wavelength of the microwave radiation. The combination of the reactive and resistive chokes reduces the leakage to a level 60 dB below the power level of the microwave source 17 (FIG. 1).

What is claimed is:

1. A microwave heating apparatus comprising:

a tubular waveguide applicator having a first end and an opposite second end, a centerline, and a circular cross section and forming a heating chamber between the first and second ends with an axis along the centerline of the tubular waveguide applicator;

a microwave source;

a waveguide feed connected between the microwave source and the tubular waveguide applicator at the first end to propagate microwaves through the tubular waveguide applicator from the first end to the second end with a dominant $TE_{01}$ pattern in the heating chamber;

a first resistive choke connected in series with the tubular waveguide applicator at the first end and a second resistive choke connected in series the tubular waveguide applicator at the second end, wherein each of the first and second resistive chokes includes:

opposite ends having openings;

a plurality of conductive vanes covered with a microwave-absorbent material and spaced apart along the axis in a chevron pattern, wherein the conductive vanes have apertures aligned with the openings in the opposite ends of the first and second resistive chokes and with the heating chamber to guide articles to be treated in the heating chamber through the first and second resistive chokes.

2. A microwave heating apparatus as in claim 1 further comprising microwave-transparent tubes extending through the central apertures and the openings in the first and second resistive chokes to guide articles to be heated in the heating chamber through the resistive chokes.

3. A microwave heating apparatus as in claim 1 further comprising a first reactive choke disposed in series with the tubular waveguide applicator between the first resistive choke and the first end of the tubular waveguide applicator and a second reactive choke disposed in series with the tubular waveguide applicator between the second resistive choke and the second end of the tubular waveguide applicator.

4. A microwave heating apparatus as in claim 1 wherein the conductive vanes are V-shaped.

5. A microwave heating apparatus as in claim 1 wherein the tubular waveguide is arranged with its axis vertical and articles to be heated advance by gravity through the heating chamber.

6. A microwave heating apparatus comprising:

a tubular waveguide applicator having a cylindrical outer wall terminating in a first end and an opposite second end to form a heating chamber having a centerline and a circular cross section between the first and second ends with an axis along the centerline of the heating chamber;

a microwave source supplying microwave energy into the tubular waveguide applicator;

a first reactive choke disposed in series with the tubular waveguide applicator at the first end of the tubular waveguide applicator;

a second reactive choke disposed in series with the tubular waveguide applicator at the second end of the tubular waveguide applicator;

a first resistive choke connected in series with the tubular waveguide applicator and the first reactive choke; and a second resistive choke connected in series with the tubular waveguide applicator and the second reactive choke;

wherein the microwave source supplies microwaves with a dominant $TE_{01}$ mode into the tubular waveguide applicator to produce a maximum electric field in the heating chamber midway between the centerline and the outer walls of the tubular waveguide applicator.

7. A microwave heating apparatus as in claim 6 wherein each of the first and second resistive chokes includes a plurality of V-shaped conductive vanes covered with a microwave-absorbent material and spaced apart along the axis in a chevron pattern, wherein the V- shaped conductive vanes have central apertures aligned with the heating chamber to pass articles to be treated in the heating chamber through the first and second resistive chokes.

8. A microwave heating apparatus as in claim 7 further comprising microwave-transparent tubes extending through the central apertures in the first and second resistive chokes to guide articles to be heated in the heating chamber through the first and second resistive chokes.

9. A microwave heating apparatus as in claim 6 wherein the first reactive choke is between the first resistive choke and the first end of the tubular waveguide applicator and the second reactive choke is disposed between the second resistive choke and the second end of the tubular waveguide applicator.

10. A microwave heating apparatus as in claim 6 further comprising a plurality of microwave-transparent ribs circumferentially spaced apart and extending inward from the cylindrical outer wall into the heating chamber to inner ends bounding a central bore to guide articles passing through the heating chamber.

* * * * *